US005916074A

United States Patent [19]

Tracy

[11] Patent Number: 5,916,074

[45] Date of Patent: Jun. 29, 1999

[54] CHILD SAFETY WINDOW GUARD

[76] Inventor: Michael L. Tracy, 7750 Zionsville Rd., Ste 750, Indianapolis, Ind. 46268-2195

[21] Appl. No.: 08/814,860

[22] Filed: Mar. 11, 1997

Related U.S. Application Data

[60] Provisional application No. 60/013,320, Mar. 13, 1996.

[51] Int. Cl.[6] ..... E05B 65/10

[52] U.S. Cl. ..... 49/141; 49/55

[58] Field of Search ..... 49/50, 55, 57, 49/141

[56] References Cited

U.S. PATENT DOCUMENTS

| | | | |
|---|---|---|---|
| 4,038,800 | 8/1977 | Daley | 52/507 |
| 4,149,342 | 4/1979 | Bowers | 49/55 |
| 4,162,590 | 7/1979 | Earley | 49/57 X |
| 4,394,805 | 7/1983 | Napper | 49/55 |
| 4,400,912 | 8/1983 | Wicks | 49/57 |
| 4,437,265 | 3/1984 | Turro et al. | 49/57 |
| 4,638,596 | 1/1987 | Gallardo | 49/141 X |
| 4,653,226 | 3/1987 | Woodrow | 49/57 |
| 4,671,012 | 6/1987 | Merklinger et al. | 49/55 |
| 4,677,791 | 7/1987 | Larson et al. | 49/463 |
| 4,680,890 | 7/1987 | Jokel | 49/55 |
| 4,685,247 | 8/1987 | Alam | 49/55 |
| 4,787,174 | 11/1988 | Brown | 49/55 |
| 4,817,334 | 4/1989 | Badger et al. | 49/55 |
| 4,837,974 | 6/1989 | Jokel | 49/55 |
| 4,884,614 | 12/1989 | Spurling | 160/225 |
| 4,899,490 | 2/1990 | Jokel | 49/55 |
| 4,937,975 | 7/1990 | Zilkha | 49/56 |
| 5,007,200 | 4/1991 | Londono | 49/141 |
| 5,018,302 | 5/1991 | Kluge | 49/56 |
| 5,060,421 | 10/1991 | Castelli | 49/463 |
| 5,070,647 | 12/1991 | Spialter | 49/55 |
| 5,117,585 | 6/1992 | Andrisin | 49/55 |
| 5,131,186 | 7/1992 | Lamont | 49/57 |
| 5,269,096 | 12/1993 | Hade . | |
| 5,272,840 | 12/1993 | Knoedler et al. | 49/463 |
| 5,339,567 | 8/1994 | Pierpont | 49/55 |
| 5,446,996 | 9/1995 | Lamont | 49/57 |

*Primary Examiner*—Jerry Redman
*Attorney, Agent, or Firm*—Ronald R. Kilponen

[57] ABSTRACT

A window guard (10) is shown for mounting in or on a window to protect children and objects from falling out. The window guard (10) has a pair of mounting brackets (12), (14) for mounting to the window. End caps (36), (38) are interconnected to a first wire subassembly (32) and second wire subassembly (34) respectively. The end caps (36), (38) are removeably attached to the first and second mounting brackets (12),(14). The first wire subassembly (32) and second wire subassembly (34) are slideably interconnected allowing the window guard (10) to fit many different sized openings. At least one emergency release button (60) mounted on the first mounting bracket (12) and engaging the end cap (36) allows for disassembly of the window guard (10) in emergency exit situations.

8 Claims, 11 Drawing Sheets

CHILD SAFETY WINDOW GUARD

CROSS REFERENCE TO PRIOR APPLICATIONS

This application claims the benefit of U.S. Provisional Application no. 60/013,320, filed Mar. 13, 1996.

BACKGROUND OF THE INVENTION

The tragedy of a child falling from a house or apartment window has become all too common, often resulting in severe injury or death of the child. Devices which are known for inhibiting window access have in the past primarily focused on preventing intrusion into the premises from outside, not on preventing a child from falling out of a window. Examples in the prior art of such devices are provided in U.S. Pat. No. 4,653,226 to Woodrow, U.S. Pat. No. 4,671,012 to Merklinger et al., U.S. Pat Nos. 4,680,890, 4,837,974, and 4,899,490 to Jokel, U.S. Pat. No. 5,070,647 to Spialter, U.S. Pat. No. 5,339,567 to Pierpont et al., U.S. Pat Nos. 5,131,186 and 5,446,996 to Lamont, U.S. Pat. No. 5,269,096 to Hade, U.S. Pat. No. 5,018,302 to Kluge, U.S. Pat. No. 4,937,975 to Zilkha, U.S. Pat. No. 4,817,334 to Badger et al., U.S. Pat. No. 4,400,912 to Wicks, Sr., U.S. Pat. No. 4,394,805 to Napper, U.S. Pat. No. 4,149,342 to Bowers, and U.S. Pat. No. 4,038,800 to Daley, Jr. While this collection of prior art is very informative on the general subject of guard devices for windows, the prior art does not specifically address the issues involved in preventing children from falling out of windows.

A number of inventors have attempted to provide various devices which restrain children from falling down stairways, or entering dangerous or unsupervised areas. Such work can be found in U.S. Pat. No. 5,060,421 to Castelli, U.S. Pat. No. 5,117,585 to Andrisin, U.S. Pat. No. 5,272,840 to Knoedler et al., U.S. Pat. No. 4,685,247 to Alam, and U.S. Pat. No. 4,677,791 to Larson et al. Devices which can guard a range of widths are also known as shown in U.S. Pat Nos. 4,787,174 to Brown, and 4,884,614 to Spurling.

U.S. Pat. No. 4,437,265 to Turro et al. teaches a safety guard apparatus for installation into the frame of a window. The Turro et al. reference teaches the use of a locking mechanism which fixes the guarding apparatus in place. It may be removed with the use of a key. Such a locking mechanism and removal procedure present a number of safety concerns. First, a key can be lost or not readily available during an emergency such as a fire. Additionally, many persons would simply not have the wherewithal to efficiently find the key, insert it in the guard device and remove the device from a window in a time of emergency, especially where the lives of the adult and a child or children are at risk. Moreover, such a locking mechanism greatly inhibits the ability of emergency personal to gain access to the premises as it is highly unlikely that those personnel will have the key. Therefore, the prior art, including the advancements made by Turro et al., fails to adequately address imperative safety concerns including emergency egress from a building or the need for easy access into a building by emergency personnel.

It is therefore the object of the present invention to provide a child safety device which may be easily installed to guard against a child inadvertently passing through the window. It is a further object of the present invention to provide a device which may be mounted on or within window frames of various widths. It is a further object to provide a window guard device which has a structural strength sufficient to withstand bumping, climbing or other activities normally exhibited by pre-school children. It is still a further object to provide a device with appropriate spacing between its members such as to prevent infants and children from being caught between any components of the window guard. Additionally, it is an object of the present invention to provide a passive window guard which may be quickly and easily removed from a window by an adult as needed in a time of emergency whether to provide immediate egress from the building or access by emergency personnel into the premises.

SUMMARY OF THE INVENTION

The child protective device of the present invention comprises a window guard device to prevent children from inadvertently falling through the window, such window guard device including an interconnected wire assembly having a first wire subassembly and second wire subassembly. The first wire subassembly further includes a first endcap and the second wire subassembly includes a second endcap. Both the first endcap and the second endcap are designed such that both may be slid by a user into one or more grooves defined by the corresponding mounting bracket. Preferably, each of the first endcap and the second endcap have extending notches aligned in series which may be slid into correspondingly aligned grooves defined by each of the first mounting bracket and a second mounting bracket. In the alternative, each mounting bracket may define an extended rib lining an interior surface of the mounting bracket such that the rib may be slid into a substantially continuous groove defined by each endcap. Each of the first endcap and the second endcap may therefore be secured to each of the corresponding mounting brackets. Also, preferably, the first mounting bracket and the second mounting bracket are mirror-images of one another. Therefore, either of the first mounting bracket or the second mounting bracket may also be secured to each endcap. As in the preferred embodiment, the mounting brackets may be secured to opposing lateral sides of a window frame or an exterior or interior wall adjacent to the window frame.

Included within each of the first and second wire subassemblies is preferably a continuous U-shaped wire having an upper wire portion and lower wire portion with an endwire portion connecting the upper wire portion and lower wire portion. A middle wire further extends from the endcap of each subassembly to the endwire portion of that subassembly. There, the middle wire is secured to the endwire portion, preferably by welding, in a perpendicular manner. Preferably, the upper and lower wire portions of each subassembly are substantially parallel within each subassembly and lie in a first vertical plane while the middle wire is out of the plane containing the upper wire portion and the lower wire portion. This requires the endwire portion to be bent near the middle wire on each subassembly.

Each subassembly is configured such that the two subassemblies are slidable past each other with the upper wire portion and lower wire portion of one subassembly being on an inside position and the middle wire of the same subassembly being on an outside position. The other subassembly is complementary in that the upper wire portion and the bottom wire portion are positioned more externally in relation to the premises with the middle wire of that subassembly positioned most internally in relation to the premises. Thus, the middle wire of each subassembly lies substantially in the plane of the upper wire portion and lower wire portion of the other, complementary subassembly. Additionally, since the two wire subassemblies are slidable past one another, the window guard of the present may be used as a passive restraint for windows of various widths.

One embodiment of the present invention presently preferred also includes an emergency release button housed within at least one of the mounting brackets. In the presently preferred embodiment, the emergency release button is housed within a cylinder such that the button may protrude through a defined opening created in each of the first endcap and second endcap. The emergency release button can be accessed from either the inside or the outside of the window. By depressing the emergency release button, the window guard may be removed by an adult with sufficient strength and coordination to depress the button and lift up on the device. This allows the device to be easily and quickly remove during times of emergency such as when immediate egress is needed or when emergency personnel need access to the premises.

Other objects and advantages of the present invention will become apparent from the following description and accompanying drawings. They are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

BRIEF DESCRIPTION OF THE DRAWINGS

The present invention is more specifically shown by the following drawings wherein.

DETAILED DESCRIPTION OF THE PREFERRED EMBODIMENTS

Figure 1:
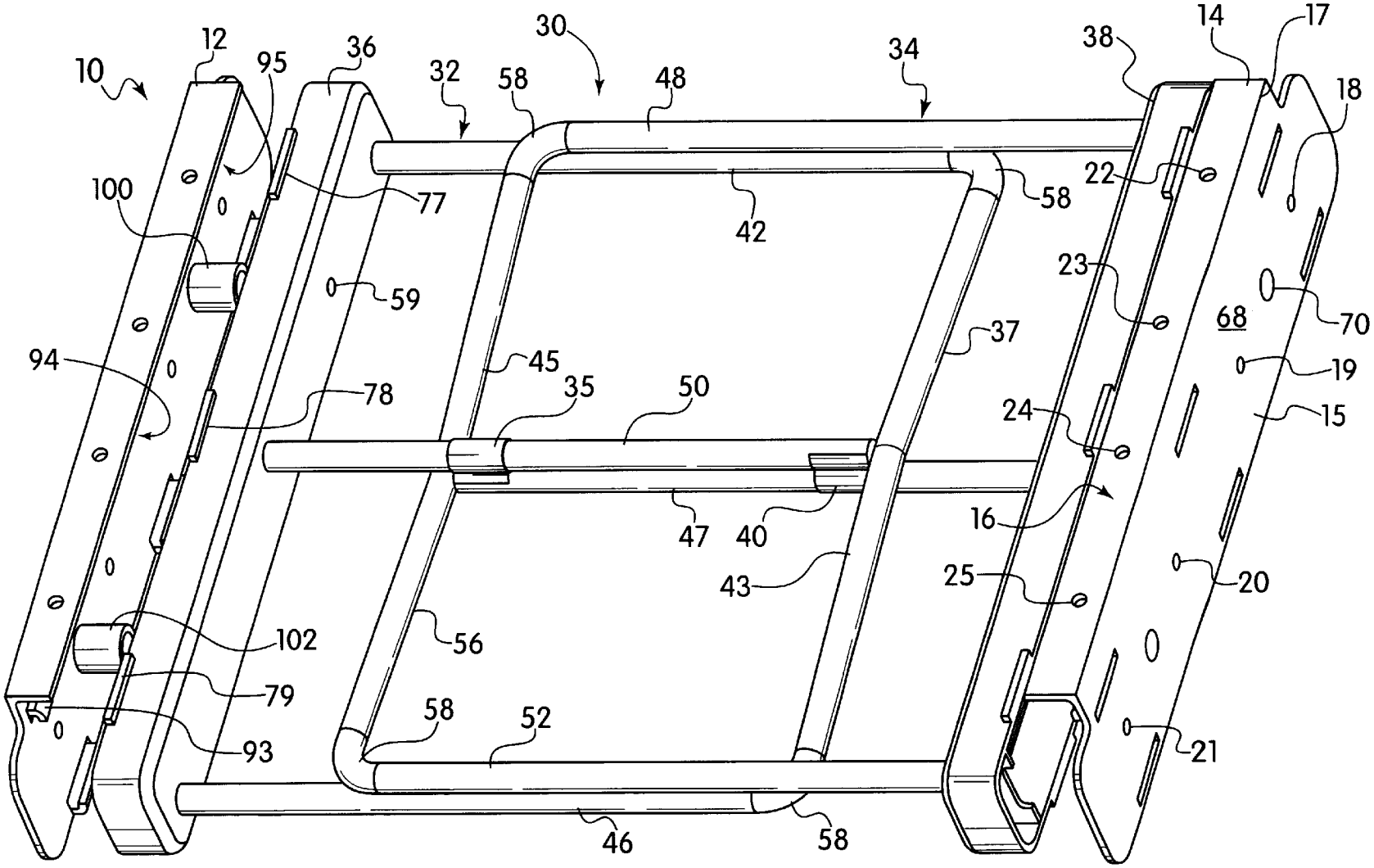
FIG. 1 is a perspective view of the preferred embodiment of the present invention.
Figure 2:
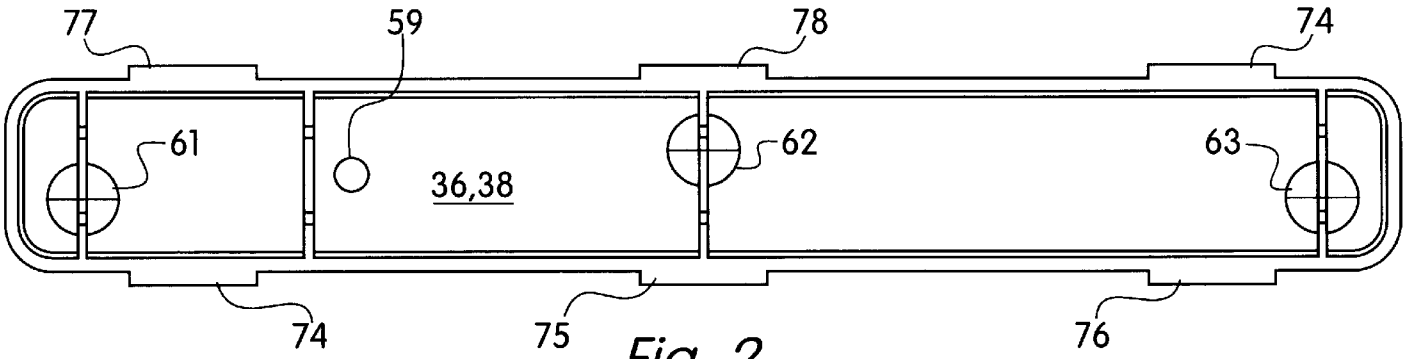
FIG. 2 is a top view of an endcap.
Figure 3:
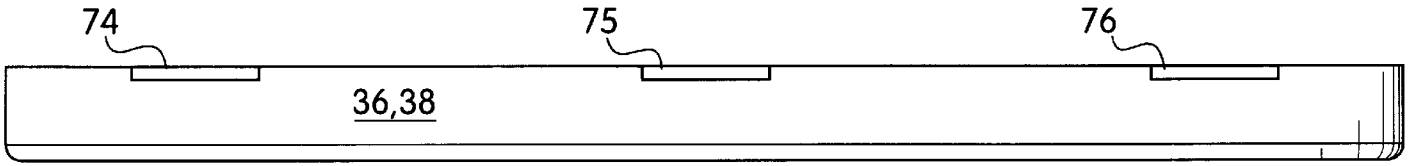
FIG. 3 is a side view of an endcap.

As may be seen in FIG. 1, one presently preferred embodiment of the present invention includes the window guard 10, a first mounting bracket 12, and a second mounting bracket 14. Each mounting bracket 12, 14 includes two planar sections, a main plane 15 and an alternate plane 16, joined along a common linear intersection 17 such that each mounting bracket 12, 14 has a substantially L-like shape when viewed from above. Preferably, the main plane 15 has significantly more surface area than the alternate plane 16. Each of the first mounting bracket 12 and second mounting bracket 14 include a plurality of apertures 18, 19, 20, 21 aligned in series along the main plane 15 and apertures 22, 23, 24, and 25 aligned in series along the alternate plane 16. Four screws may be placed through each aperture of either the main plane 15 or the alternate plane 16 to secure each mounting bracket 12, 14 to a window frame interior or an adjoining wall on either the interior of a building or on the building exterior. The main plane 15 may be used in such a manner when the window guard 10 is secured to the interior of a window frame and the alternate plane 16 may be utilized when the window guard 10 is secured to either the inside or the outside of an adjoining wall.

Figure 7:
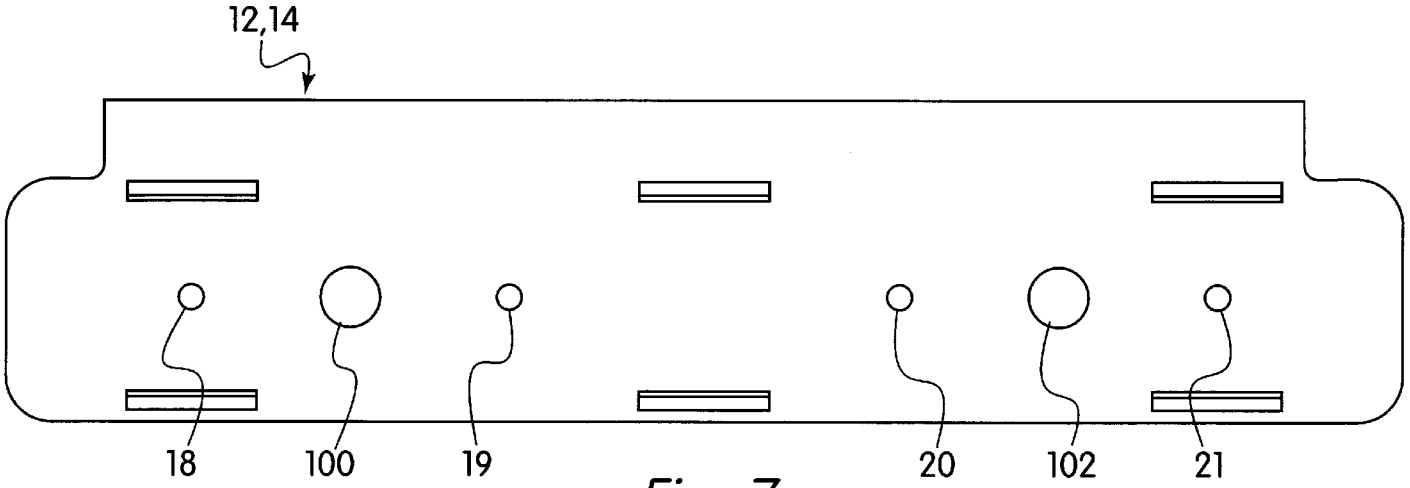
FIG. 7 is a top view of a mounting bracket.
Figure 9:
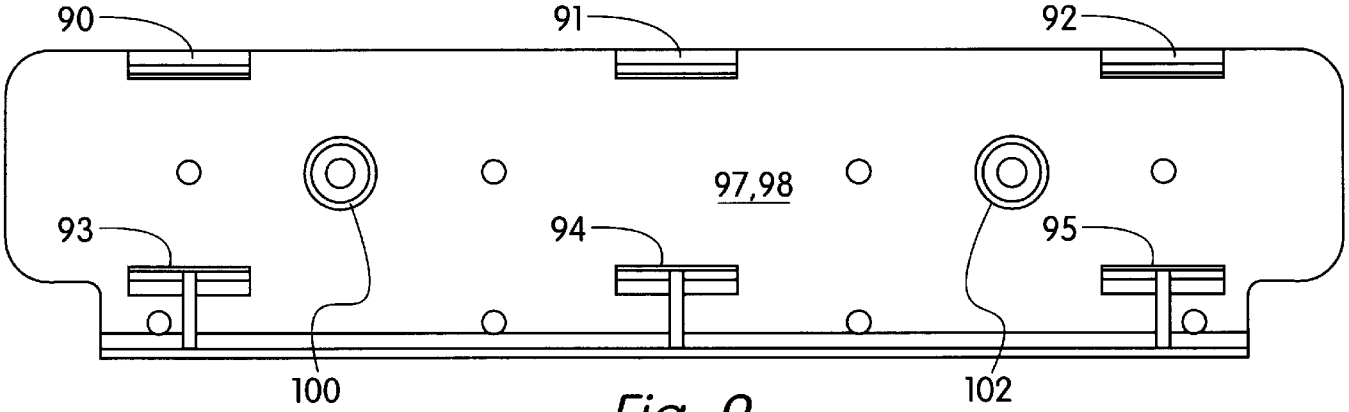
FIG. 9 is a bottom view of a mounting bracket.

The window guard 10 further includes an interconnected wire assembly 30. The interconnected wire assembly 30 includes a first wire subassembly 32 and a second wire subassembly 34. Each wire subassembly 32, 34 is substantially identical. Each of the first wire subassembly 32 and second wire subassembly 34 include first endcap 36 and second endcap 38 respectively. Preferably, endcaps 36 and 38 are substantially rectangular in shape as viewed from above and capable of being secured to the respective mounting bracket 12, 14. In the embodiment presently preferred and shown in FIG. 7, each mounting bracket 12, 14 includes a plurality of defined grooves. As shown in FIG. 9, six defined grooves, 90, 91, 92, 93, 94, and 95 are formed on an inner surface 97 of each mounting bracket 12, 14. As shown further in FIG. 9, grooves 90, 91, and 92 are in-line as are grooves 93, 94, and 95.

Figure 10:
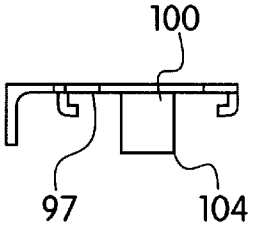
FIG. 10 is a sectional view of a mounting bracket taken along line A—A of FIG. 9.
Figure 6:
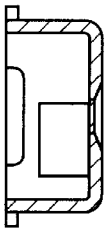
FIG. 6 is a sectional view of an endcap taken along line A—A of FIG. 4.

Additionally defined by each mounting bracket 12, 14, has at least one and preferably two housing cylinders 100, 102. As shown in FIG. 10, such cylinders 100, 102 are most preferably tapered from an inner surface 97 of each mounting bracket 12, 14 downward to an annular rim 104. Preferably, cylinder 100 is positioned between apertures 18 and 19 while cylinder 102 is positioned between apertures 20 and 21.

Figure 4:
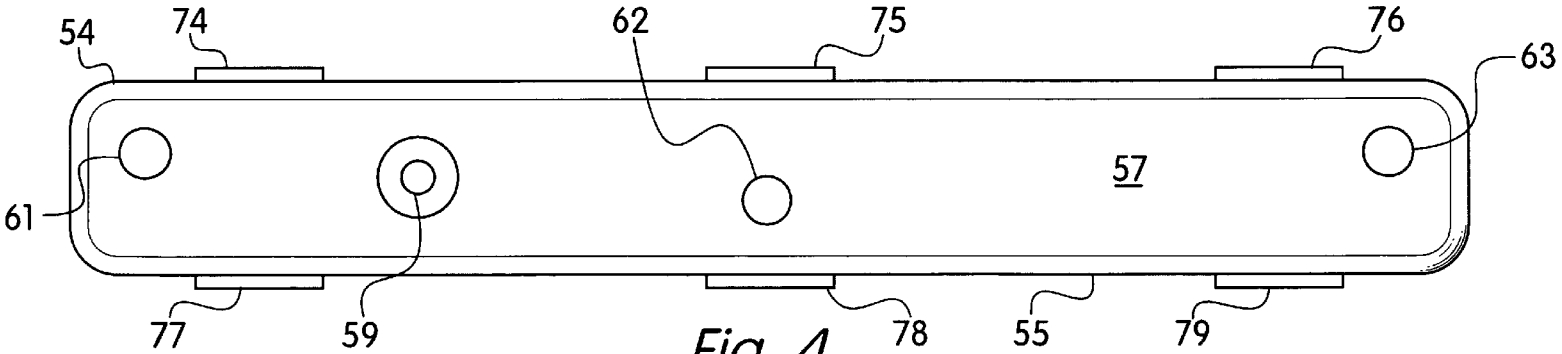
FIG. 4 is a top view of an endcap.
Figure 5:
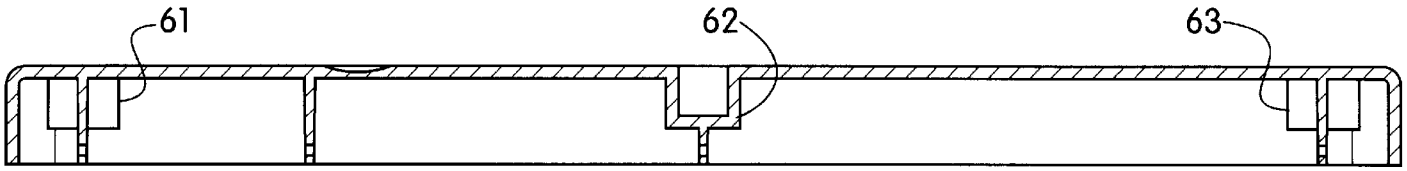
FIG. 5 is a sectional view of an endcap taken along line B—B of FIG. 4.

Each endcap 36, 38 of the preferred embodiment, as shown by FIGS. 2–6, includes several features which make the endcaps 36, 38 suitable for connecting to the mounting brackets 12, 14 as well as supporting the interconnected wire assembly 30 along each lateral side. Most specifically, each endcap 36, 38 includes a top wire well 61, a middle wire well 62, and a bottom wire well 63 in a mounting surface 57. The top wire well 61 and bottom wire well 63 lie along a common plane exclusive of the middle wire well 62. Additionally, both endcap 36 and endcap 38 include a plurality of notches projecting outwardly from an endcap base 49. As shown in FIGS. 2–5, there are preferably six notches approximately evenly spaced along two opposing sides 54, 55 of each endcap 36, 38. Notches 74, 75, and 76 are shown in FIG. 4 on side 54 and notches 77–79 are shown on side 55. The indicated six notches 74, 75, 76 and 77, 78, 79 are capable of being slid into the grooves 90, 91, 92 and 93, 94, 95 defined by each mounting bracket 12, 14. Thus, each endcap 36, 38 can be slidably installed and secured to each corresponding mounting bracket 12, 14. Moreover, each endcap 36, 38 may further include a transverse strut, not shown, between the opposing sides 54, 55 to provide additional structural support and help prevent the endcap 36, 38 from slipping out of position.

Secured to the first endcap member 36 is a plurality of wires, preferably including a continuous U-shaped wire 37 secured within the top wire well 61 and the bottom wire well 63 of either endcap 36 or 38. The U-shaped wire 37 extends continuously from the top wire well 61 to the bottom wire well 63. The U-shaped wire 37 further defines an upper wire portion 42, a substantially perpendicular endwire portion 43 relative to the upper wire portion 42, and a lower wire portion 46. A middle wire 47 is secured, preferably by a weld, to both the endcap 38 and the second endwire portion 56 of the continuous U-shaped wire 45. Preferably, the middle wire 47 is secured approximately midway from each of the upper wire portion 42 and the lower wire portion 46. Similarly, a continuous U-shaped wire 45 forms a second upper wire portion 48, a second lower wire portion 52, and a second endwire portion 56 connecting the second upper wire portion 48 and the second lower wire portion 52. A second middle wire 50 runs substantially parallel to both the upper and lower portion of the U-shaped wire 45. The second middle wire 50 is secured to both endcap 36 and a endwire portion 43, preferably by a weld. Preferably, a rounded wire corner 58 provides a transition between each of the upper wire portions 42, 48 and lower wire portions 46, 52, to the respective endwires 43 and 56. The rounded wire corner 58 substantially eliminates any sharp, potentially harmful, corners or pointed elements from the preferred embodiment of the present invention. Most preferably, the rounded wire corner 58 is formed with the continuous U-shaped wires 37, 45. However, other alternative embodiments utilizing separate corner members are possible.

Within each subassembly 32, 34, the upper wire portions 42 and 48 are substantially parallel to the corresponding lower wire portions 46 or 52. That is the first upper wire portion 42 and the first lower wire portion 46 lie in a first common plane exclusive of the middle wire 47. Likewise, the second upper wire portion 48 and second lower wire portion 52 lie in a second common plane exclusive of the second middle wire 50. The first and second wire subassemblies 32, 34 are further positioned such that each may slide past the other in a range of motion from a closed position to an open position wherein only a relatively small part of subassemblies 32 and 34 overlap. Additionally, while the present embodiment has described in detail the use of three substantially parallel wire portions in each subassembly, those of ordinary skill in the art will readily recognize that a plurality of wires, including combinations of more than three wires used in concert, may also be employed.

Figure 8:
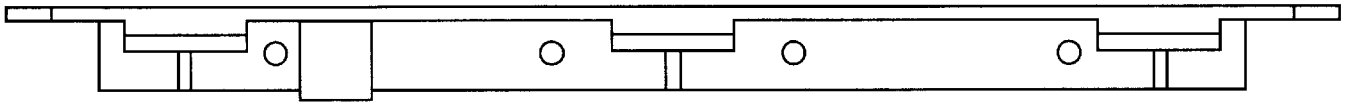
FIG. 8 is a side view of a mounting bracket.

Additionally, the subassemblies 32, 34 are held together by mechanical means, including but not limited to, a band placed around proximate wires. Preferably, a metal clamp 35 and second clamp 40 holds adjoining wires in line. This is especially valuable for holding the middle wires 47, 50. The metal clamp 35 may be shaped as a cut-off "FIG. 8" wherein the top loop of the "FIG. 8" encircles one wire and the cut-off bottom half of the "FIG. 8" clamps onto the approximate top half of the wire directly abutting. This clamping means is especially useful in the manufacture of the presently preferred embodiment of the present invention.

In a most preferred embodiment of the present invention, upper wire portion 42, 48, lower wire portion 46, 52 and middle wires 47, 50 of each subassembly 32, 34 are a maximum of four inches apart thereby preventing a small child from becoming stuck or being caught in the interconnected wire assembly 30 or either subassembly 32, 34. Additionally, the preferred embodiment utilizes wire assemblies which will withstand a minimum of one hundred fifty pounds of downward force exerted on the overlapping subassemblies 32, 34.

The present invention also includes an emergency release button 60. The emergency release button 60 is preferably housed within the main plane 15 of at least one endcap 36 or 38. The emergency release button 60 is even more preferably housed within cylinder 100 or 102. The cylinder 100,102 as shown in FIGS. 7, 8, 9, 10, 11B and 12B shows a chamber 106 and ledge 108 near the annular rim 104. To install the release button 60 and spring 64 (not shown) in the cylinder 100,102 requires inserting the release button 60 and spring 64 into the cylinder 100,102 from the inner surface 97, 98 such that the lip 122 of release button 60 engages the ledge 108 of the cylinder 100,102 and is retained within the chamber 106. The backing 66 is affixed to the inner surface 97, 98 to retain the spring 64 and release button 60 within the cylinder 100, 102. This causes the spring 64 to bias the emergency release button 60 lip 122 against the cylinder 100, 102 ledge 108 such that the tip 120 extends beyond the annular rim 104. The tip 120 can thus be engaged in the button hole 59 in the first and second end cap 36, 38 when the device is assembled.

Figure 14:
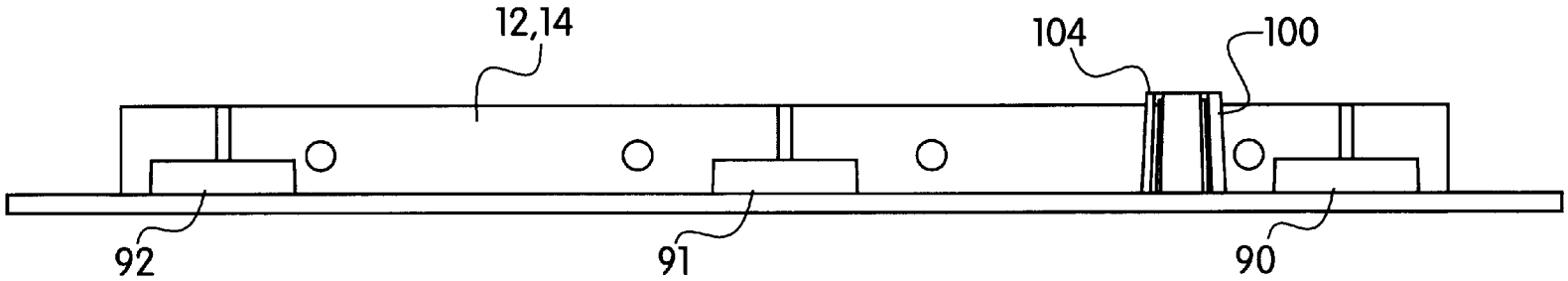
FIG. 14 is an alternate side view of a mounting bracket.
Figure 15:
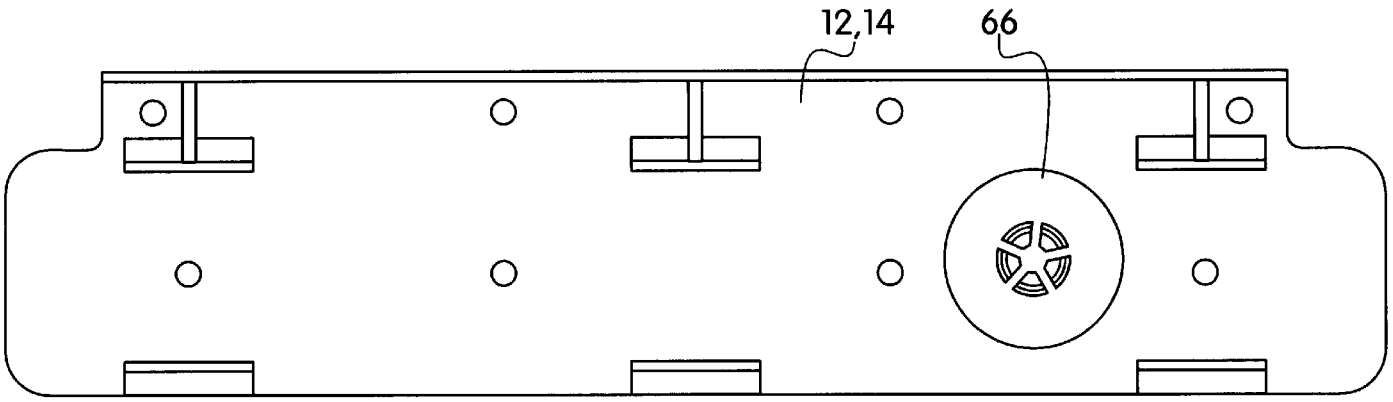
FIG. 15 is a bottom view of a mounting bracket.
Figure 17:
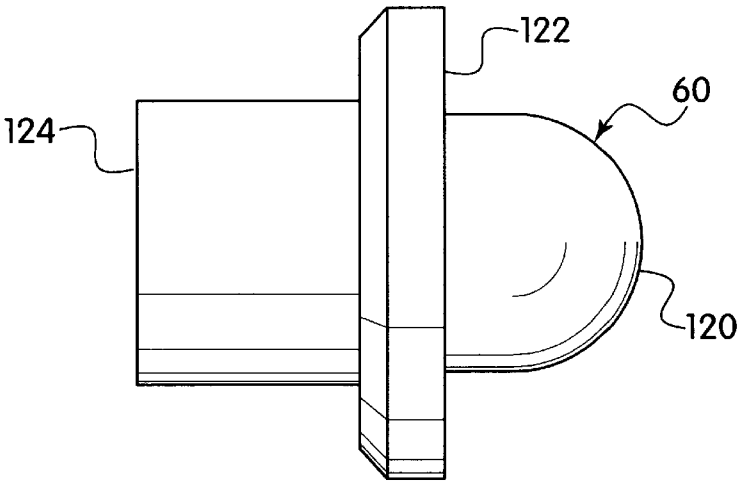
FIG. 17 is a side view of the emergency release button.
Figure 16:
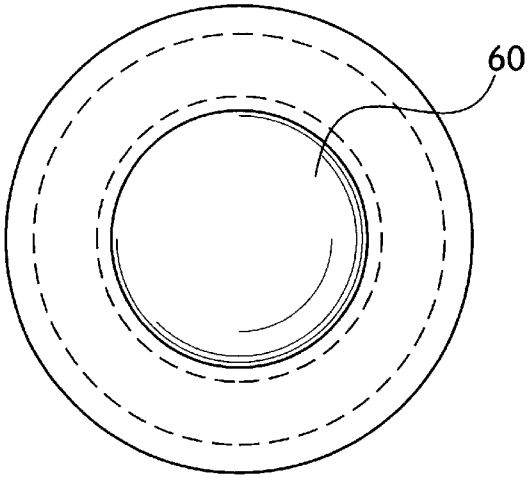
FIG. 16 is a top view of the emergency release button.
Figure 22:
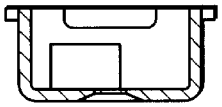
FIG. 22 is a sectional view taken along line A—A of FIG. 19.
Figure 18:
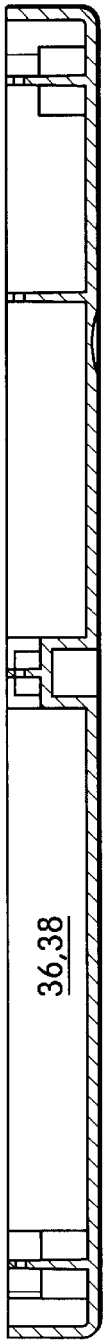
FIG. 18 is an alternate view of an endcap.
Figure 19:
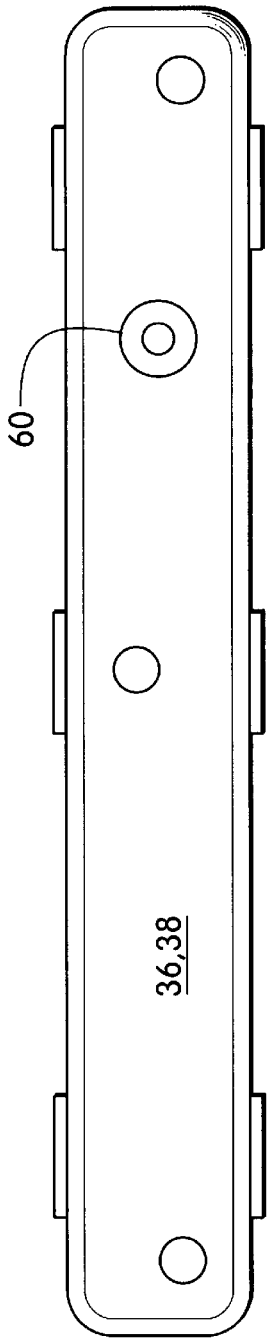
FIG. 19 is a top view of an endcap.
Figure 20:
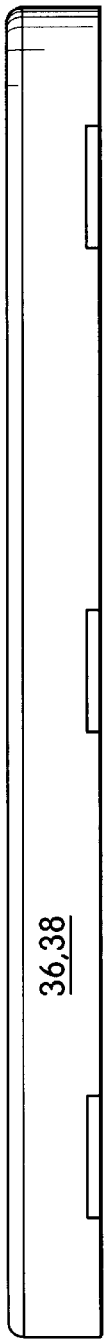
FIG. 20 is a side view of an endcap.
Figure 21:
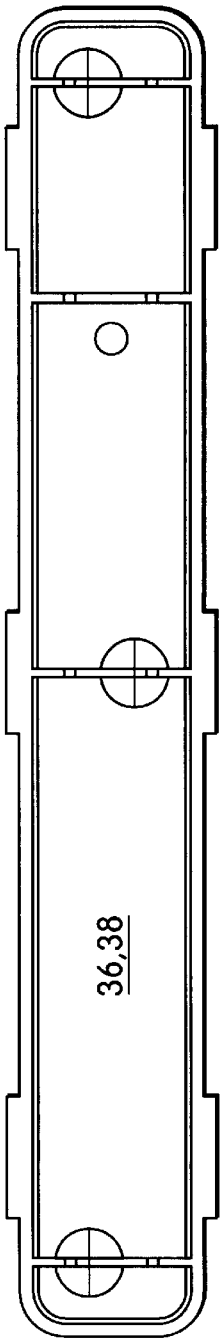
FIG. 21 is an interior view of an endcap.
Figure 23:
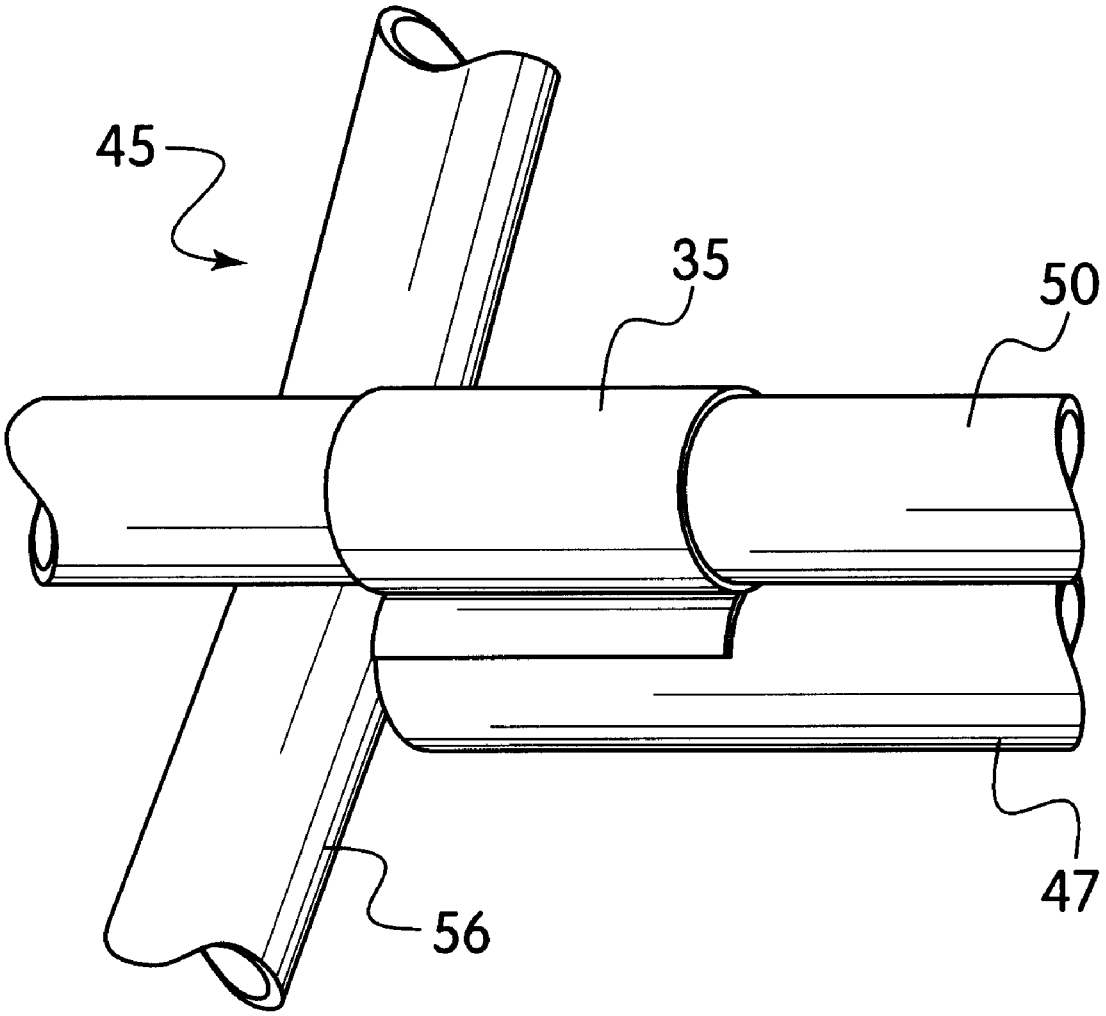
FIG. 23 is a detailed perspective view of the wire linking means.
Figure 24:
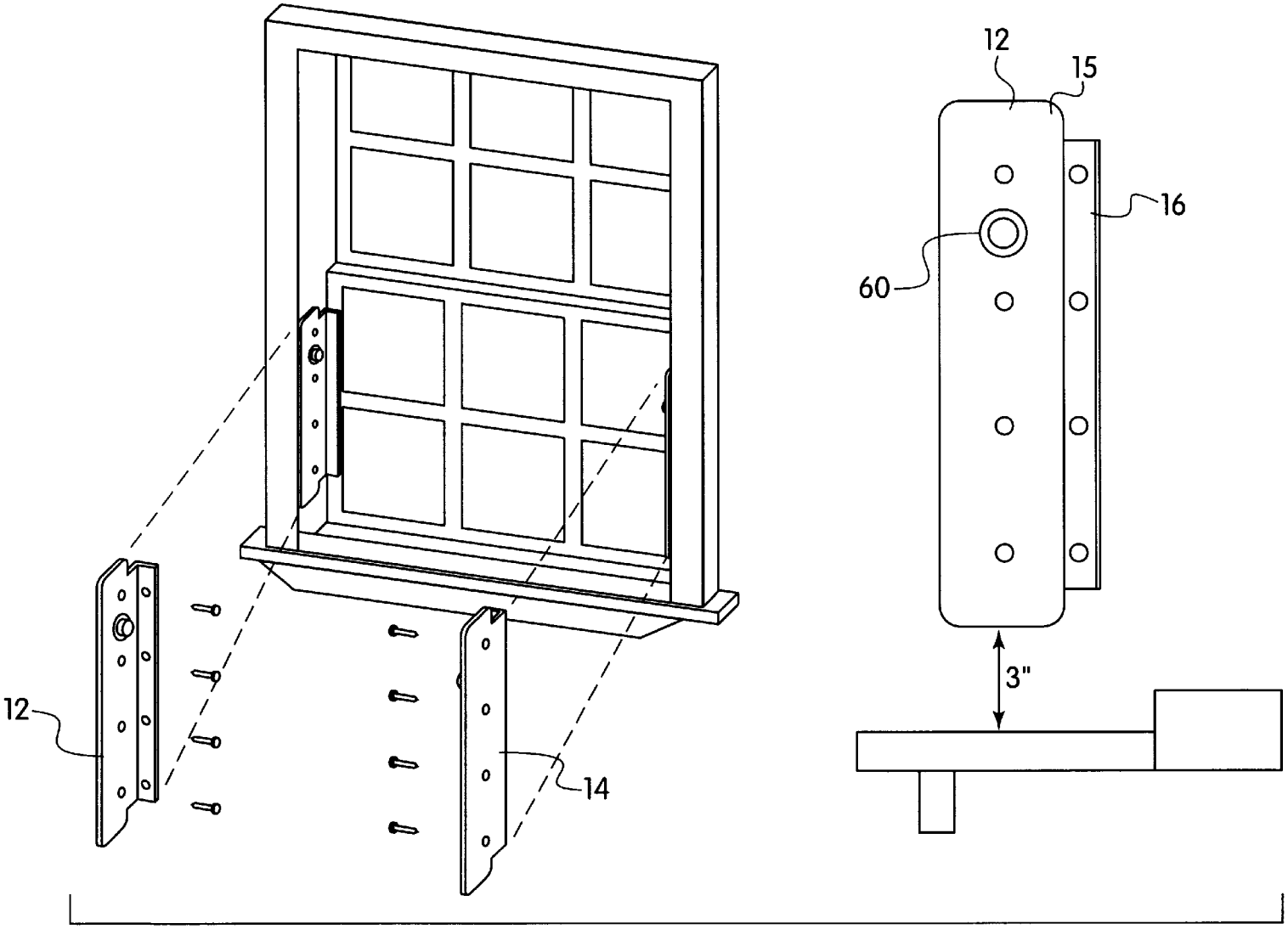
FIGS. 24 and 25 are schematic diagrams showing proper installation of the preferred embodiment of the present invention.
Figure 25:
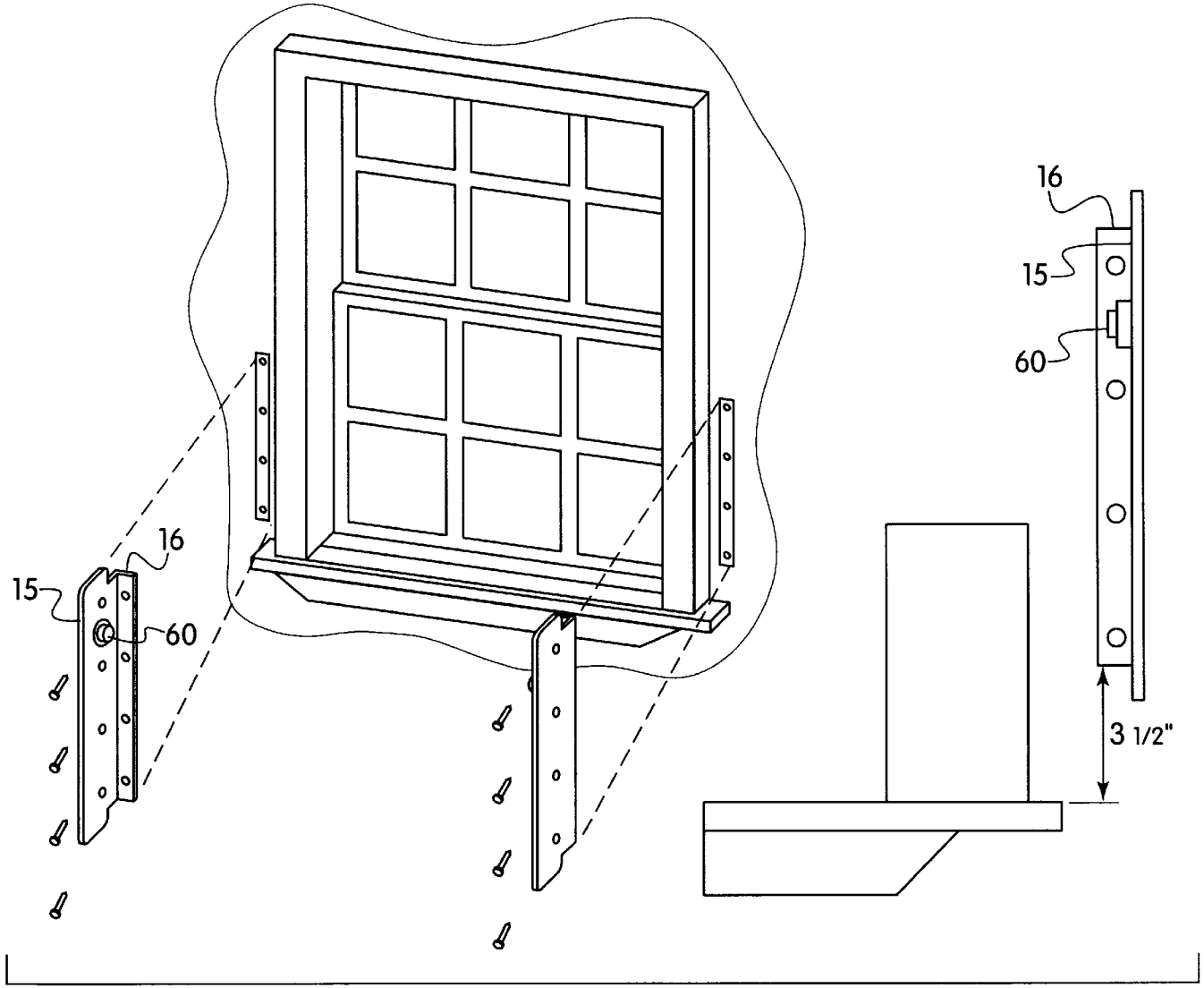

It is most preferred that the uppermost cylinder of 100 or 102 house the emergency release button 60. The emergency release button 60 is supported within the cylinder 100 or 102, by a spring 64, FIGS. 14, 17 placed within the cylinder 100 or 102. The spring 64 is chosen to provide sufficient tension to prevent the emergency release button 60 from falling down into the cylinder or even out of the mounting bracket 12, 14. The emergency release button 60 is further defined by a rounded tip 120 on an upper end and a circumferential lip 122 circumscribing the tip 120. On the lower end of the emergency release button 60 is rod 124. The spring 64 must also be chosen however to respond to the firm depression of a user to allow the user to quickly and efficiently remove the interconnected wire assembly 30. The emergency release button 60 penetrates and extends through the end cap 36 at a button hole 59.

Figure 11B:
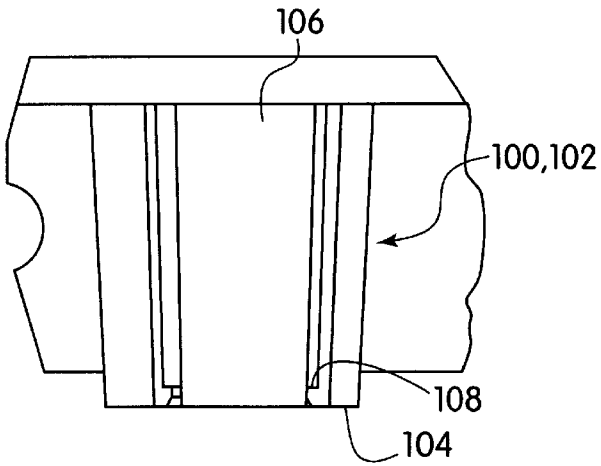
FIG. 11B shows a cross sectional view of the cylinder.
Figure 11A:
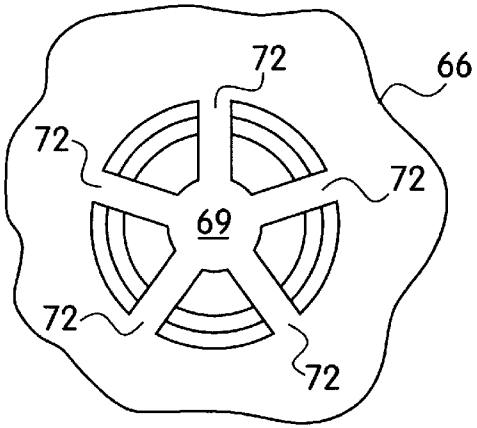
FIG. 11A is a top view of the emergency release button backing.
Figure 12B:
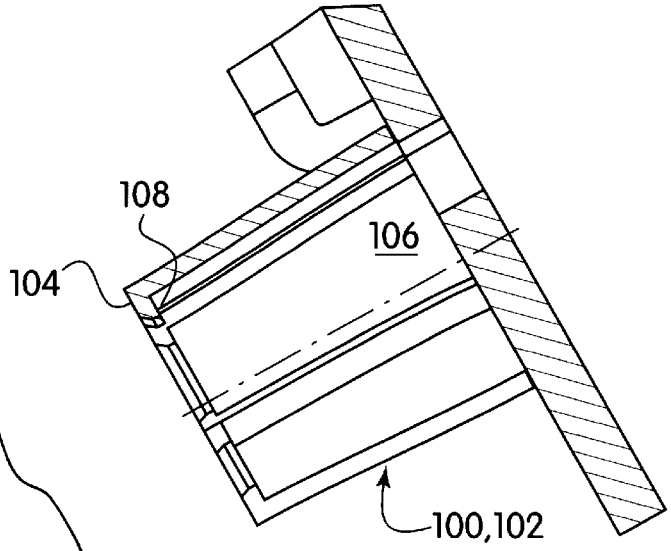
FIG. 12B shows a side view of the cylinder.
Figure 12A:
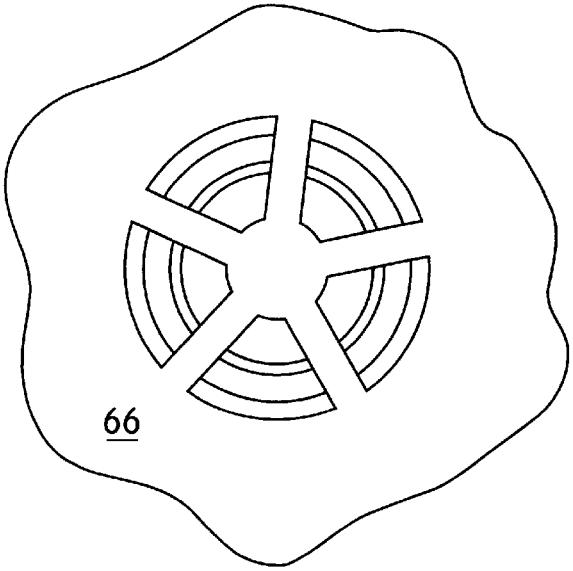
FIG. 12A is an alternate view of said backing.
Figure 13:
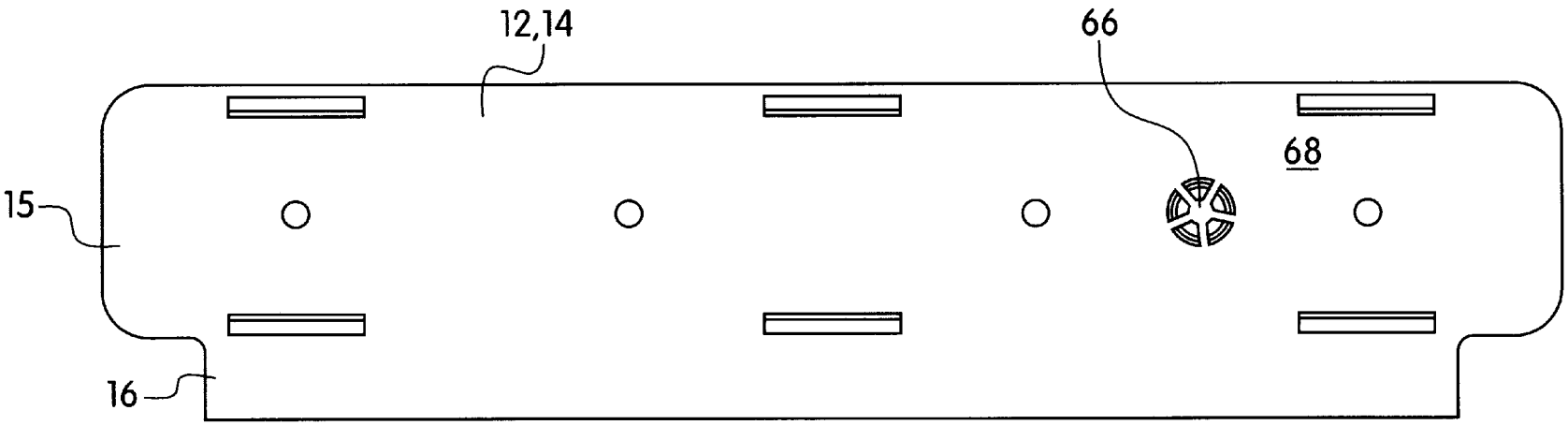
FIG. 13 is an alternate top view of a mounting bracket.

As further shown by FIGS. 11–12, a backing 66 is employed along the outside surface 68 of the main plane 15 to further prevent the emergency release button 60 and spring 64 from falling out of the window guard 10. Preferably, the backing 66 is webbed with a central portion 69 covering an opening 70 at the outside surface 68 of the main plane 15. A series of connecting strips 72 joins the central portion 69 to the remainder of the backing 66. Most preferably, such strips 72 are approximately sixty-six degrees apart in a circular arrangement.

Various materials may be used for the backing 66 and its above-described components, but a flexible, resilient material such as polyvinyl chloride or ABS is preferred. Other engineering plastics may be utilized as needed as well for the backing 66. Likewise, the mounting brackets 12, 14 and endcaps 36, 38 may also be constructed from a variety of materials, including but not limited to, PVC, ABS, commercially available engineering plastics, and metals such as aluminum. The continuous U-shaped wires of each subassembly 32, 34 and the middle wires 47, 50 wires are preferably constructed from metal.

It should be noted that the backing 66 is not visible or exposed when the main plane 15 of each mounting bracket 12, 14 is used to mount the window guard 10. However, when the alternate plane 16 of each mounting bracket 12, 14 is used, the outside surface of each main plane 15 is exposed. In a such a case, the backing 66 prevents the spring 64 and emergency release button 60 from potentially falling out of the window guard 10 where small children could possibly find and ingest those items.

Installation of the presently preferred embodiment of the present invention is further facilitated in that once both the first mounting bracket 12 and second mounting bracket 14 are secured to a window frame or wall, the remaining interconnected wire assembly 30 can then be installed by expanding the wire assembly 30 to the appropriate width and sliding the first endcap 36 and the second endcap 38 over the corresponding first mounting bracket 12 or second mounting bracket 14 with the notches of each endcap 36, 38 being held by the respective defined grooves.

An alternate embodiment of the present invention, a rib 200, not shown, may be employed which extends from each of the mounting brackets 12, 14 into the interior of a window. An extended groove 202, not shown, may be further defined by each endcap 36, 38 such that the rib 200 may be slid along the extended groove 202 and held securely in place.

Thus, it is readily apparent that the present invention has several advantages over the prior art. First, the window guard 10 of the present invention may be installed between side walls of a window frame or on either the inside or outside surface of an adjoining wall. The installer is further provided with only three main parts, the two mounting brackets 12 and 14 and interconnected wire assembly 30 which slides onto the mounting brackets 12, 14 at the endcaps members 36 and 38. The window guard 10 may further be used in a window of various widths simply by sliding the first and second subassemblies 32, 34 apart or together to create the appropriate width. Perhaps most importantly, the present invention provides a window guard 10 which not only prevents children from inadvertently falling out of a window, it also may be removed quickly in a time of emergency by depressing the emergency release button 60, pulling upward on the interconnected subassembly and removing the interconnected wire assembly 30 from the window. This action can be readily accomplished by an adult. A child of tender years would typically be incapable of performing such a coordinated activity.

While specific details and embodiments of the present invention have been described in detail herein, it will be appreciated by one of ordinary skill in the art that various adaptations and equivalents could be employed. For example, although many of the drawings herein disclose specific dimensions, it will be recognized that other dimensions may be more suitable for some uses. Thus, the present invention cannot be limited to the specific parameters herein set forth.

What is claimed is:

1. A window guard comprising:

first and second mounting brackets for fixedly engaging a fixed object, a first end cap for removably engaging the first mounting bracket, a U-shaped first wire subassembly attached to the first end cap near each end, a U-shaped second wire subassembly attached to a second end cap near each end, the second end cap removably engaging the second mounting bracket;

the first wire subassembly assembled from an upper wire attached to an end wire by a wire corner, said end wire attached to a lower wire by a wire corner, the second wire subassembly assembled from a second upper wire attached to a second end wire by a wire corner and said second end wire attached to a second lower wire by a wire corner;

one end of a middle wire attached to the second end cap and a second end of the middle wire affixed to a clamp and the second end wire, the clamp slidably engaging a second middle wire, one end of the second middle wire attached to the first end cap and a second end of the second middle wire affixed to a second clamp and end wire, the second clamp slidably engaging the middle wire;

said first wire subassembly and said second wire subassembly and said middle wire and second middle wire configured to allow an increase or decrease in the distance between the first end cap and second end cap;

an emergency release button contained within a cylinder on the first mounting bracket, a spring interacting with the release button, biasing a tip away from the cylinder, the tip penetrating and extending from a button hole in the first end cap when the first end cap engages the first mounting bracket; and an emergency release button contained within a cylinder on the second mounting bracket, a spring interacting with the release button, biasing a tip awav from the cylinder, the tip penetrating and extending from a button hole in the second end cap when the second end cap engages the second mounting bracket.

2. The window guard of claim 1 further comprising:

a backing secured to an outside surface of the first and second mounting brackets for retaining the emergency release buttons relative to the mounting brackets.

3. The window guard of claim 1 wherein:

the spring utilized is of a predetermined stiffness to prevent the compression of the emergency release buttons and subsequent release of the first and second end caps from the first and second mounting brackets by a child of tender years.

4. The window guard of claim 1 wherein:

the wire assembly is capable of withstanding a minimum of one hundred fifty pounds without failure.

5. A window guard comprising:

first and second L-shaped mounting brackets for fixedly engaging a fixed object, said mounting brackets having a main plane an inner surface and perpendicular alternate plane, a plurality of grooves extending from the inner surface, a plurality of apertures and at least one opening formed through the main planes, a plurality of apertures formed through the alternate plane, at least one cylinder extending from the inner surface terminating in an annular rim at a predetermined distance from the inner surface, said cylinder for housing a spring and an emergency release button;

first and second substantially rectangular end caps for removably affixing to the first and second mounting bracket, said end caps having a plurality of wire wells in a mounting surface, a plurality of notches extending from opposing sides of the end caps for engagement with the corresponding number of grooves in the mounting brackets, at least one button hole for penetration by the emergency release button when said end caps are engaged with the mounting brackets;

a wire assembly comprising a first wire subassembly and second wire subassembly, said wire subassemblies having upper wires, end wires and lower wires interconnected by wire corners, said first and second wire subassemblies engaging the top wire well and bottom wire well of the first and second end caps respectively, a middle wire engaging the middle wire well of the second end cap with a first end and a second middle wire engaging the middle wire well of the first end cap with a first end, a clamp affixed near a second end of the middle wire and the clamp slidably located around the second middle wire, said second end of the middle wire affixed to the second end wire, a clamp affixed near a second end of the second middle wire and the clamp slidably located around the middle wire, said second end of the second middle wire affixed to the end wire; and said first and second wire subassemies configured to allow an increase or decrease in the distance between the first and second end caps for mounting the window guard in various sized openings.

6. The window guard of claim 5 further comprising:

a backing secured to an outside surface of the first and second mounting brackets for retaining the emergency release buttons relative to the mounting bracket.

7. The window guard of claim 5 wherein:

the spring utilized is of a predetermined stiffness to prevent the compression of the emergency release button and subsequent release of the first and second end caps from the first and second mounting brackets by a child of tender years.

8. The window guard of claim 5 wherein:

the wire assembly is capable of withstanding a minimum of one hundred fifty pounds without failure.

* * * * *